United States Patent [19]

Hawkins

[11] 4,195,749

[45] Apr. 1, 1980

[54] TWO PIECE CONTAINER END

[75] Inventor: Gerald P. Hawkins, Arvada, Colo.

[73] Assignee: Occidental Industries, Ltd., Tukwila, Wash.

[21] Appl. No.: 945,193

[22] Filed: Sep. 25, 1978

[51] Int. Cl.[2] ..... B65D 41/02; B65D 41/32

[52] U.S. Cl. ..... 220/268; 220/265; 220/260; 220/334; 220/359

[58] Field of Search ..... 220/260, 265, 266, 268–274, 220/359, 334, 337, 339

[56] References Cited

U.S. PATENT DOCUMENTS

| | | | |
|---|---|---|---|
| 3,910,453 | 10/1975 | Kneuseh et al. | 220/260 |
| 4,024,980 | 5/1977 | Kneuseh et al. | 220/359 |
| 4,122,971 | 10/1978 | Potts | 220/359 |

*Primary Examiner*—George T. Hall

*Attorney, Agent, or Firm*—Dowrey & Cross

[57] ABSTRACT

A container end for containers such as beverage containers provided with a dispensing opening sealed by a discrete tab secured to the inner side of the end and seated in the dispensing opening such that a closure portion of the tab may be manually depressed inward about a hinge point to expose the dispensing opening. The container end member and the tab are separate and discrete from one another and are joined mechanically by means of a retainer pin integrally formed in the container end. The peripheries of the dispensing opening and the tab closure portion are cooperatively associated to provide an adhesive annulus into which the tab closure portion is seated and to maintain the elevation of the tab closure portion below the elevation of the container end surrounding the dispensing opening.

7 Claims, 5 Drawing Figures

TWO PIECE CONTAINER END

BACKGROUND OF THE INVENTION

This invention is an easy opening end for containers such as beverage containers. The end is provided with a preformed opening in which a discrete tab is sealably secured. The opening may be exposed by depressing the tab into the container, the tab swinging about a hinge point and remaining secured to the end adjacent to the opening.

Depressible tab ends typically include an end member and a tab for sealing a suitable dispensing opening provided in the end member. The container having such an end is opened by pushing the tab into the container. The end member and tab may be formed in combination from the same piece of material—usually aluminum—so that the tab is torn from the end member during opening, as disclosed in U.S. Pat. Nos. 2,176,898, 2,261,117, 3,227,304, 3,246,791, 3,334,775, 3,355,058, 3,472,415, 3,628,695, 3,741,432, or 3,779,417 (sometimes referred to herein as "one piece" ends). According to another fabrication technique, the end member and tab may be formed independently from the same or different materials so that a tab-end member seal (usually adhesive) is broken without tearing the tab or end member during opening, as disclosed in U.S. Pat. Nos. 2,147,004, 3,236,409, 3,261,498, or 3,871,550 (sometimes referred to herein as "two piece" ends).

One piece ends are undesirable because they tend to develop sharp edges about the dispensing opening when opened, and, in some container applications for pressurized liquids, often require excessive push-in force to effect opening. Ends of this type additionally are uneconomical because of the various folding, lancing and/or scoring operations required during fabrication. Hysteresis effects attendant such forming operations tend to cause leakage when the end is subjected to stress, strain or temperature changes.

One prior one piece end, for example, employs a small pressure release tab in combination with a larger dispensing tab (see previously mentioned U.S. Pat. No. 3,741,432). This construction tends to be impractical in many applications involving pressurized liquids because it is difficult to obtain acceptable tab-end member seal overlap without excessive weakening of the tab, or utilizing tab materials of uneconomical thicknesses. In many practical applications, for example, this overlap is highly susceptible to stress, strain and the so-called "oil can" effect. This one piece end construction also tends to be undesirable from the standpoint of consumer safety because the small tab can, when detatched from the closure member, pass through the larger dispensing opening along with the contents of the container and be swallowed. Another drawback of this and other prior ends of both types (one or two piece) is that the dispensing opening is of generally circular or round outline and, hence, does not provide optimum pourability or drinkability.

Another prior one piece end, disclosed in previously cited U.S. Pat. No. 3,779,417, provides a more desirable dispensng opening, but is fabricated by the so-called "triple fold" technique which, once again, requires uneconomical folding and scoring operations.

Two piece ends, while offering to eliminate some or all of the problems associated with the folding, lancing and/or scoring operations mentioned above, typically are uneconomical or non-competitive with one piece ends on a mass production basis because they impose excessive material and labor costs, or are incompatible with existing container treatment techniques. They additionally, by virtue of their two piece construction, tend to lack durability or exhibit unreliable seals, the tab often being depressed inadvertently during container fabrication, assembly or stacking.

The two piece end disclosed in previously mentioned U.S. Pat. No. 3,871,550, for example, utilizes an expensive plastic tab and opening liner in combination with a metal end member which, when employed with certain beverages (e.g., beer) requiring pasteurization, tend to cause premature seal breakage due to their different thermal expansion properties. The plastic push-in tab button additionally is so exposed as it projects above the face of the closure member that it can be engaged and depressed inadvertently during container fabrication or stacking.

Regarding the prevention of such inadvertent depression of the tab, the two piece end discussed in previously mentioned U.S. Pat. No. 2,147,004 provides a separate outer disk covering for this purpose. This cover, however, involves added expenditures incident to its application to the lid and, for this reason, is uneconomical on a mass production basis. The one piece end disclosed in previously mentioned U.S. Pat. No. 3,246,791 includes a single raised portion for a similar purpose; however, the raised portion is of a construction inappropriate to prevent or substantially minimize the so-called "oil can" effect which, in the environment of a two piece end, could tend to impair seal integrity and, in fact, the disclosed construction is expressly used in combination with supplemental end member stiffeners.

Depressible tab, easy opening end designs have proliferated in recent years primarily as a result of state legislation against "ring" tab or "tear-away" tab beverage containers being promulgated because of litter problems created by users detaching the tabs and discarding them on the ground. As of the date of this application, none of the depressible tab easy opening end designs that have reached the marketplace have met the need for an acceptable replacement for the "ring" tab end. These designs have not received user acceptance either because the opening or openings in the container end are too difficult to expose or because users risk cutting their fingers or thumbs or breaking their fingernails when the closure sealing the opening suddenly gives way.

Other designs have not made the hurdle from concept or prototype to the marketplace. Some of these designs could not be manufactured at the high speeds required by today's standards. The depressible tabs of other such designs could not reliably seal the end openings against leakage under internal pressures generated either during the canning process or thereafter in the case of carbonated and fermented beverages.

SUMMARY OF THE INVENTION

This invention successfully overcomes the problems and disadvantages associated with prior depressible tab, easy opening ends by providing an end which offers substantial economy and versatility, together with protection against premature or inadvertent seal breakage.

The container end comprises an end member having a dispensing opening therein, a discrete depressible tab secured to the end member, and a suitable adhesive sealing the end member and tab together around the periphery of the opening. The end member is embossed and formed such that an adhesive well is provided around the periphery of the opening and such that the perimeter of the opening is defined by a downturned portion of the outer surface of the end member rather than by an exposed sheared edge. The tab is formed such that an exposed land is provided that fills the opening in the end member and such that an adhesive well is provided around the periphery of the exposed land. The respective adhesive well geometries are designed to cooperate when the end member and tab are assembled to provide an annular adhesive pocket in which a suitable adhesive will maintain a seal until force is applied to depress the tab and upon application of such force will separate in shear, thus not requiring an inordinate force on the tab to break the seal. The tab is mechanically secured to the inner surface of the end member by means of a retainer pin formed in the end member. A midsection of the tab, extending between the retainer pin and the opening, is so formed as to provide a hinge point about which the exposed land of the tab will swing when depressed into the container well. The respective adhesive geometries further cooperate to enhance the resistance of the two piece end to "oil-canning" and counteract structural weaknesses that might otherwise have been created by the removal of material to create the opening. The dispersing opening in the end is non-circular and defined by generally radially extending sides and an arcuate interconnecting side near the periphery of the center panel of the end member. The design of the formed exposed land of the tab is such that the tab is essentially self-aligning during assembly of the tab and end member.

As will now be appreciated, the container end of this invention offers substantial economy and versatility. Inasmuch as the tab and end member are formed independently, complicated forming apparatus are not needed. Likewise, the tab and end member need not be lanced and/or scored to obtain the desired results. Consequently, the end member of this invention may be fabricated of less malleable metallic materials, such as steel, and even may be fabricated of plastic, fiber and other non-metallic materials on an economical basis. (While preferably the tab and end member are formed of the same materials, they could, in some practical applications, be formed of different materials of generally similar, or even varying, thermal expansion properties). The end member, additionally may be fabricated from standard end blanks (often called "shells"). The end of this invention further does not require exotic sealants, appropriate commercially available sealants such as wax or hot melt adhesives being suitable in many practical applications. The same sealant additionally could be used to seal both the tab and rim liner.

These and other features, objects and advantages of the present invention will become apparent in the detailed description and claims to follow, taken in conjunction with the accompanying drawings in which:

DETAILED DESCRIPTION OF THE DRAWINGS

Figure 1:
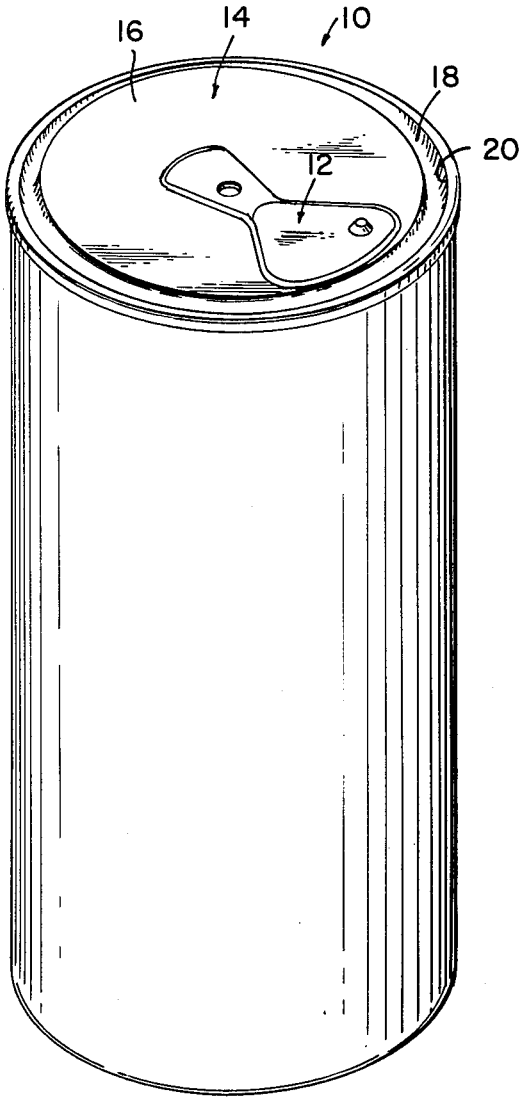
FIG. 1 is a perspective plan view of a container to which the end of this invention has been seamed.
Figure 4:
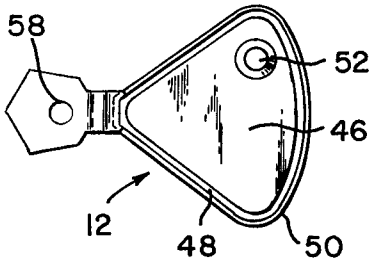
FIG. 4 is a top plan view of the tab of the invention.

Referring to FIG. 1, the two piece, depressible tab, easy opening end of this invention is shown as it would appear after being sealed onto a metal container body by conventional double seaming operations. The container end 10 comprises a depressible tab 12 and an end member 14, the latter comprising a center panel 16, and a peripheral bead 18 around the panel and an upstanding wall 20 outwardly of the bead. As shown in FIG. 4, a flange 22 extends outwardly from the top of wall 18, on the outer end of which is a curled edge 24 prior to the end being sealed onto a container body. The end member 14 as thus far described is of conventional design and therefore may be handled by conventional machinery during the canning process. The unique design features of the end of this invention, which will now be described, permit the utilization of commercially available solid center panel shells if desired.

Figure 3:
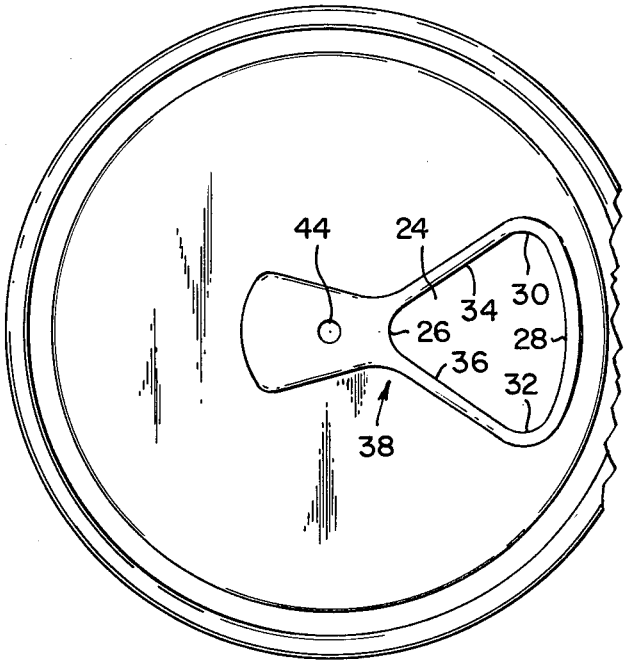
FIG. 3 is a plan view of the outer surface of the container end member of this invention.

With reference to FIG. 3, the center panel 16 is provided with a dispensing opening 24 commencing near the center of the center panel in a small radius arc 26 and extending toward the periphery of the center panel. The opening 24 becomes progressively wider as it approaches the center panel periphery and terminates in an arc 28 that is concentric with the center panel periphery. The opening is somewhat triangular with corners in the form of small radius arcs 30 and 32 connected by arc 28 and connected with arc 26 by radials 34 and 36, respectively.

Figure 2:
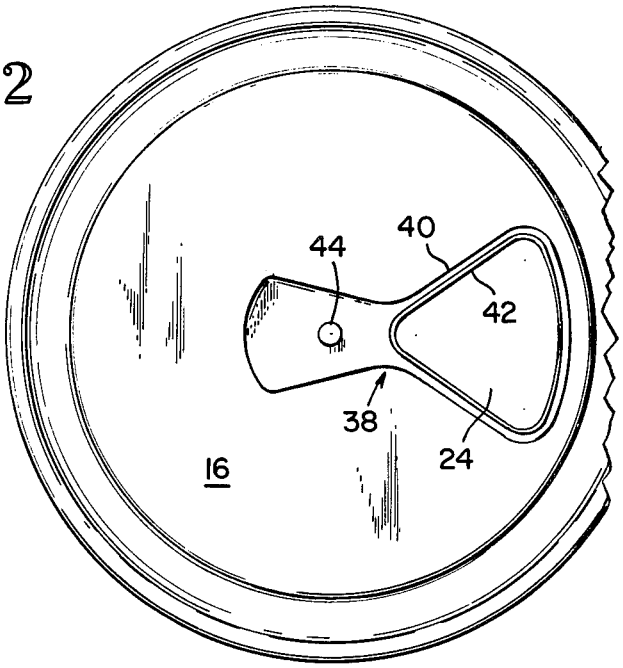
FIG. 2 is a plan view of the inner surface of the container end member of this invention.
Figure 5:
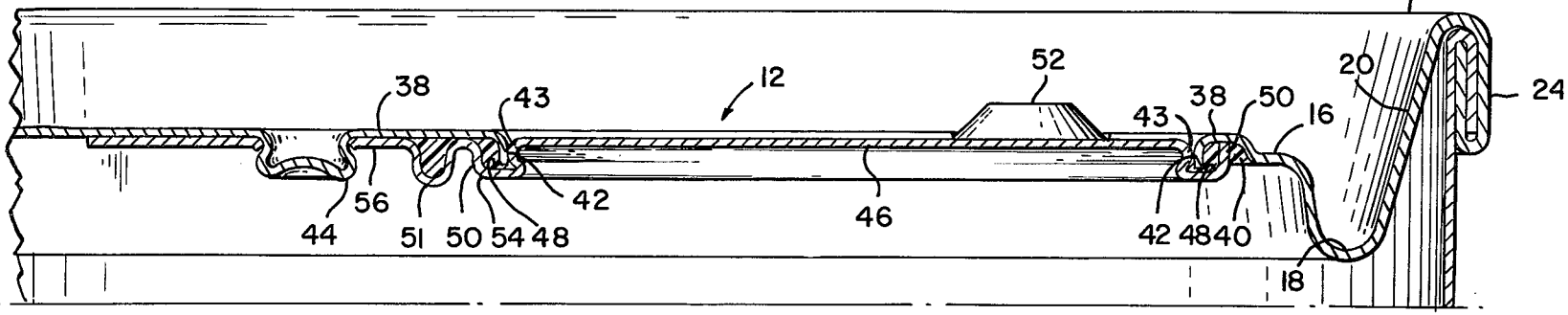
FIG. 5 is a partial cross section of the end of this invention.

With reference to FIGS. 2 and 5, the center panel 16 is embossed to provide a raised section 38 that is larger than, but generally conforms to, the planar outline of tab 12. The center panel 16 is formed to provide a peripheral adhesive channel 40 around the opening 24 and the center panel is also formed to provide a downturned portion 42 of the center panel, the exposed surface of which defines opening 24. The center panel 16 is formed at its center to provide a downwardly-extending, closed bottom cylindrical retainer pin 44 that extends through the tab 12 and secures the tab to the underside of the center panel.

With reference to FIGS. 4 and 5, the tab 12 is formed to provide a raised land 46, a peripheral adhesive channel 48 around the land 46 and an upturned portion 50 which constitutes the outer wall of channel 48. The respective heights of land 46, upturned portion 50 and downturned portion 42 are such that the outer surface of land 46 is slightly below the elevation of the surrounding embossed portion 38 of the center panel 16 when the tab 12 is secured to the underside of the center panel with the upturned portion 50 in abutment with the underside of the embossed portion 38 as shown in FIG. 5. The peripheral wall 43 of land 46 is formed to match the geometry of the opening 24 as defined by downturned portion 42. Consequently, expansion forces generated by pressurized contents within the container will not result in an unacceptably large "oil-canning" effect. This is so because expansion forces exerted on the underside of land 46 will be transferred through upturned portion 50 to the embossed portion 38 of the center panel, and tend to pry downturned portion 42 upward. This tendency, however, is resisted by the abutment of peripheral wall 43 and downturned portion 42, the result therefore being that the combination will tend to respond in much the same manner as a solid center panel.

Because of the relative configurations of portions 42 and 50, depressing lid 16 will cause the lid's sealing surface to move parallel to the center panel's sealing surface and thereby shear the adhesive seal provided by adhesive contained in channels 40 and 48. The force required to shear the adhesive seal is significantly less than the force required to break an adhesive seal were the sealing surfaces of the lid and center panel to be oriented such that depressing the lid would require movement of the lid's sealing surface perpendicularly away from the center panel's sealing surface. Moreover, internal expansion forces will not appreciably affect the "shearability" of the adhesive.

Internal expansion forces will of course have an effect on the force required to depress the lid. To minimize this effect, the pressure seal can be most easily broken to permit internal pressure release by concentrating the opening force in one of the lid's corners. To direct a consumer to this feature, a raised button 52 may be formed in one of the lid's corners (A consumer's natural tendency will be to press on the button rather than on some other area of the lid.) Consequently the opening force applied by the consumer will be concentrated in the corner of the opening 24 adjacent to the botton, the point where the least force is required to unseal the lid. Once the internal pressure is relieved, relatively little force is required to shear the remainder of the tab's periphery away from the adhesive and depress the tab into the opening.

As can be seen in FIG. 5, a portion of tab 12 underlying the center panel adjacent the commencement of opening 24 (i.e. adjacent arc 26 designated in FIG. 3) is formed to provide a corrugation 51. This corrugation in combination with the adjacent section of upturned portion 50 provides a serpentined configuration when viewed in side elevation, the width of which as seen in FIG. 4 is the narrowest part of the tab. This serpentined configuration constitutes the hinge point for the tab.

When the tab is depressed, it will pivot about the point of least resistance which is the area of bend 54. In the process of forming this serpentined configuration, the resultant working of the tab material will leave residual stresses in the hinge. When the tab is depressed, tending to straighten bend 54, the stresses in the vicinity will be relieved. Consequently, there will be less of a tendency for the depressed portion of the tab to spring-back upward and choke off the opening 24. (Furthermore, because the adhesive seal is broken in shear when the tab is depressed, rather than in tension, the degree to which adhesive in the vicinity of arc 26 will cling to the separation surfaces will be reduced. Consequently there will be less of a tendency for the depressed portion of the tab to spring-back as a result of the adhesive's tensile elasticity). Corrugation 51 also insulates the tail portion 56 of the tab (which is secured by retainer pin 44) from the hinging action created by depressing the head portion of the lid.

The tail portion 56 is provided with a circular opening 58 into which retainer pin 44 is inserted. Opening 58, prior to assembly of the tab with the end member, is of a diameter slightly less than the outer diameter of pin 56. Consequently, upon being inserted into opening 58, pin 56 will deform the edge of the opening downward as shown in FIG. 5. Subsequent to insertion, the end of pin 56 is deformed upward to the configuration shown in FIG. 5, causing the pin's sidewall to flare outward into abutment with the downturned edge of opening 58 to securely fasten the tab and end member together.

While the preferred embodiment of the invention has been illustrated and described herein, it should be understood that variations will be apparent to one skilled in the art. Accordingly, the invention is not to be limited to the specific embodiment illustrated and described herein and the true scope and spirit of the invention are to be determined by reference to the appended claims.

What is claimed is:

1. A depressible tab container end which comprises an end member having a dispensing opening therein; a discrete depressible tab secured to said end member and having a closure portion operatively associated with the end member opening to seal that opening, a retainer portion secured to the inner side of said end member, and a corrugated hinge portion intermediate the closure and retainer portions formed to bend when said closure portion is manually displaced from said dispensing opening, the corrugation in said hinge portion being generally parallel to the desired bending axis of said hinge portion.

2. The container end of claim 1 wherein the peripheries of said tab closure portion and said dispensing opening are so formed as to define an adhesive annulus therebetween when said tab closure portion is in a sealing relationship with said dispensing opening.

3. The container end of claim 1 wherein the peripheries of said tab closure portion and said dispensing opening are so formed as to limit the extent that said tab closure portion extends into said dispensing opening such that the main elevation of said tab closure portion is less than the end member elevation surrounding said dispensing opening.

4. The container end of claim 1 wherein said end member is embossed outward surrounding said dispensing opening and formed with an inwardly extending lip that defines the periphery of said dispensing opening; and wherein said tab closure portion is formed to provide a circumferential outwardly-opening annulus bounded by an upturned lip, said upturned lip terminating in the vicinity of said hinge portion and being so constructed and arranged as to impart structural rigidity to said tab closure portion and to transmit bending forces to said hinge portion whereby the seal between said end member and said tab closure portion will break in the vicinity of said hinge portion.

5. The container end of claim 1, wherein said closure portion includes an upturned portion about its periphery, said upturned portion being so formed as to abut edge on against the interior surface of the end member adjacent the dispensing opening when said closure portion is in a sealing relationship with said dispensing opening.

6. The container end of claim 1, wherein said retainer portion is secured to the inner side of said end member by a rivet integrally formed in and inwardly protruding from said end member.

7. The container end of claim 1 wherein said tab closure member includes a peripheral wall for engaging the edge of said dispensing opening.

* * * * *